United States Patent [19]

Sekiguchi et al.

[11] Patent Number: 4,850,211

[45] Date of Patent: Jul. 25, 1989

[54] METHOD OF CONTROLLING ELIMINATION OF ROLL ECCENTRICITY IN ROLLING MILL AND DEVICE FOR CARRYING OUT THE METHOD

[75] Inventors: Kunio Sekiguchi, Kawagoe; Hajime Kai, Fuchu; Masaru Miyokawa, Narashino; Kenji Ueda, Chiba, all of Japan

[73] Assignees: Kabushiki Kaisha Toshiba, Kawasaki; Kawasaki Steel Corporation, Kobe, both of Japan

[21] Appl. No.: 43,546

[22] Filed: Apr. 28, 1987

[30] Foreign Application Priority Data

Apr. 30, 1986 [JP] Japan ..... 61-100547

[51] Int. Cl.[4] ..... B21B 37/08

[52] U.S. Cl. ..... 72/8; 72/11; 72/20; 72/21; 72/241; 364/472

[58] Field of Search ..... 72/8–12, 72/6, 16, 19, 20, 241, 21; 364/472

[56] References Cited

U.S. PATENT DOCUMENTS

| | | | |
|---|---|---|---|
| 3,709,009 | 1/1973 | Shiozaki et al. | 72/8 |
| 4,222,254 | 9/1980 | King, Jr. et al. | 72/8 |
| 4,531,392 | 7/1985 | Puda | 72/19 X |
| 4,580,224 | 4/1986 | Gerber | 72/6 X |
| 4,691,547 | 9/1987 | Teoh et al. | 72/16 |

FOREIGN PATENT DOCUMENTS

| | | |
|---|---|---|
| 56-22281 | 5/1981 | Japan . |
| 60-141321 | 7/1985 | Japan . |

*Primary Examiner*—Lowell A. Larson
*Assistant Examiner*—Steven B. Katz
*Attorney, Agent, or Firm*—Foley & Lardner, Schwartz, Jeffery, Schwaab, Mack, Blumenthal & Evans

[57] ABSTRACT

A rolling load signal is detected during a few rotations of a top and a bottom backup roll at different detection time points at which the top and bottom backup rolls are out of phase from each other and then are analyzed by Fourier analysis so as to detect the amplitudes and phases of the eccentricity of the top and bottom backup rolls separately, whereby the roll gap is controlled and the separately detected eccentricity of the top and bottom backup rolls is thus obtained. Even when there is a difference in roll eccentricity frequency between the top and bottom backup rolls and even when external disturbances exist due to the aging of the roll eccentricity and to the estimated errors of the mill constant M and the plasticity coefficient Q of a piece of metal to be rolled, the roll eccentricity can be suitably adjusted so that the roll eccentricity can be detected with a high degree of accuracy and then eliminated.

5 Claims, 6 Drawing Sheets

METHOD OF CONTROLLING ELIMINATION OF ROLL ECCENTRICITY IN ROLLING MILL AND DEVICE FOR CARRYING OUT THE METHOD

BACKGROUND OF THE INVENTION

1. Field of the Invention

The present invention relates to a method of controlling the elimination of roll eccentricity in a rolling mill of the type having backup rolls and a device for carrying out the method.

2. Description of Prior Art

In the rolling mill for the production of steel sheets or the like, the variations in thickness of the piece of metal as well as the variations in tension resulting from the variations in roll gap caused by the eccentricity of backup rolls adversely affect the quality of rolled products and the stable rolling operation.

Especially, the rolling mills provided with hydraulic screw-down mechanism having a fast response time have been recently used, but in order to obtain the rolled products having a high degree of accuracy of thickness by utilizing such fast response time, the eccentricity of the backup rolls must be completely eliminated.

Now let us consider a rolling mill comprising a pair of working rolls and a pair of backup rolls. In general, the motion of roll eccentricity contains not only a fundamental frequency but also harmonic frequency components. But, for the sake of simple explanation, let us consider only the fundamental frequency component whose period is equal to one rotation of each backup roll.

When the eccentricity of the top and bottom backup rolls is represented by $\Delta S_A$ and $\Delta S_B$, respectively, the combined roll eccentricity $\Delta S_E$ is expressed by Eq. (1):

$$\Delta S_E = \Delta S_A + \Delta S_B \quad (1)$$

$$\Delta S_A = X_A \cdot \sin(\theta_A + \Phi_A) \quad (2)$$

$$\Delta S_B = X_B \cdot \sin(\theta_B + \Phi_B) \quad (3)$$

where $X_A$: an amplitude of eccentricity of the top backup roll;

$X_B$: an amplitude of eccentricity of the bottom backup roll;

$\theta_A$: an angle of rotation of the top backup roll;

$\theta_B$: an angle of rotation of the bottom backup roll;

$\Phi_A$: a phase of the top backup roll when $\theta_A=0$; and $\Phi_B$: a phase of the bottom backup roll when $\theta_B=0$.

In general, the degree of roll eccentricity is detected in response to the combined eccentricity $\Delta S_E$ of the top and bottom backup rolls detected from the rolling load signal.

Recently, there has been devised and demonstrated a method in which, in order to control the crown or the shapes of rolled metal pieces, the pheripheral speeds of the upper and lower working rolls are respectively varied. In this method, however, the top and bottom backup rolls are different in eccentricity frequency from each other so that the degrees of eccentricity of the top and bottom backup rolls must be detected separately and then their eccentricity must be eliminated. Furthermore, even when the peripheral speed of the upper and lower working rolls are same, when the top and bottom backup rolls are different in diameter from each other, they are different in eccentricity frequency from each other.

For instance, the method for separately detecting the eccentricity of the top and bottom backup rolls is disclosed in detail in Japanese Patent Publication No. 56-22281 or Japanese Patent Application Laid-Open No. 60-141321. According to this method, the screw-down is carried out in the so-called kiss roll mode; that is, in the mode in which no piece of metal is rolled, so that some great load is produced and the load signal is subjected to the Fourier transformation by using the rotational speeds and load signals of the top and bottom backup rolls, whereby the eccentricity of the top and bottom backup rolls can be separately detected.

In response to the angles of rotation of the top and bottom backup rolls, respectively, the amplitude of eccentricity thus detected are reproduced and the reproduced signals are applied as the reference signals to the roll gap control device in the direction in which the variations in roll gap due to the roll eccentricity can be eliminated, so that the variations in roll gap due to the roll eccentricity can be eliminated and consequently the thickness of the rolled product can be controlled with a high degree of accuracy. It follows therefore that when the eccentricity detected in the so-called kiss roll state is equal to that detected during the rolling operation, the control for eliminating the roll eccentricity can be carried out with a high degree of accuracy.

It is well known to those skilled in the art that there exists the variation in roll eccentricity or the aging of the roll eccentricity depending upon the magnitude of the rolling load so that under various rolling conditions, it is almost impossible to detect the roll eccentricity with a high degree of accuracy by the method described above.

Furthermore, in the case of the completely continuously type rolling mill in which the pieces of metal are successively welded into a continuous piece which in turn is continuously rolled without stopping the rolling operation of the rolling mill, the chance for obtaining the so-called kiss roll state is less so that the application of the above-described method is difficult.

SUMMARY OF THE INVENTION

In view of the above, the primary object of the present invention is to provide a method of controlling the elimination of the roll eccentricity and a device best adapted to carry out the object in rolling mill which can overcome the above and other problems encountered in the prior art methods and devices so that the roll eccentricity can be detected with a high degree of accuracy.

To the above and other ends, the present invention is characterized in that the rolling load signal is detected during a time period during which each backup roll rotates a few times at a timing at which the relative phases of the top and bottom backup rolls are different; the rolling load signal thus obtained is subjected to the Fourier analysis so that the eccentricity of the top and bottom backup rolls are obtained separately; and in response to the eccentricity thus obtained, the roll gap is controlled.

Even when the top and bottom backup rolls are different in roll eccentricity frequency from each other, the eccentricity of the top and bottom backup rolls is detected in response to the data obtained during the rolling operation independently of each other. Therefore, even when there exist external disturbances due to the aging of the roll eccentricity and estimated errors of the mill constant M and the plasticity coefficient Q, the roll eccentricity can be detected with a high degree of accuracy so that the thickness of the rolled products can be controlled with a high degree of accuracy and the stable rolling operation can be ensured.

DETAILED DESCRIPTION OF THE PREFERRED EMBODIMENT

Figure 1:
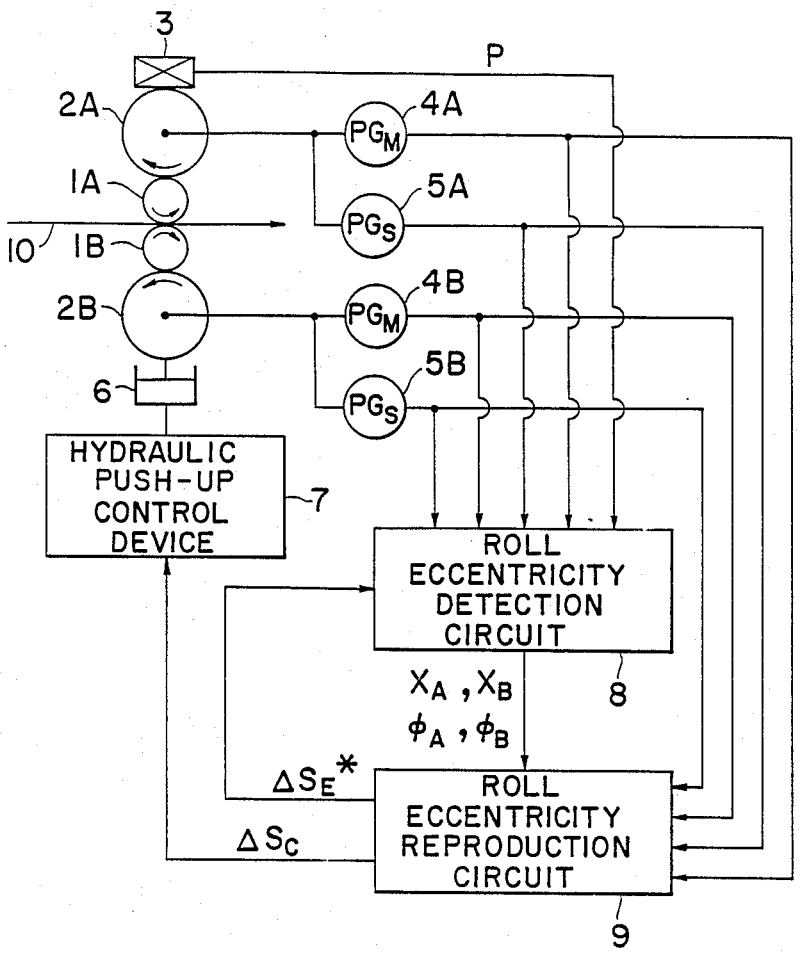
FIG. 1 is a block diagram of a preferred embodiment of the present invention.

A preferred embodiment of the present invention applied to a rolling mill provided with backup rolls will be described below in detail, referring first to FIG. 1.

The rolling mill embodying the present invention comprises upper and lower working rolls 1A and 1B and top and bottom backup rolls 2A and 2B so as to roll a piece of metal 10. The top and bottom backup rolls 2A and 2B are provided with mark pulse generator ($PG_M$) 4A and 4B each of which is adapted to generate one mark pulse whenever each backup roll makes one rotation and sampling pulse generators ($PG_S$) 5A and 5B, respectively, each of which is adapted to generate a predetermined number n of sampling pulses (for instance, n=64) whenever each backup roll makes one rotation. The output pulses derived from these four pulse generators 4A, 4B, 5A and 5B are applied to a roll eccentricity detection circuit 8 and a roll eccentricity reproduction circuit 9. In addition, the rolling mill is provided with a load sensor 3 for detecting the rolling load P and the output from the load sensor 3 is applied to the roll eccentricity detection circuit 8.

According to an algorithm to be described below, the roll eccentricity detection circuit 8 detects the amplitudes of eccentricity $X_A^*$ and $X_B^*$ and the phase $\Phi_A^*$ and $\Phi_B^*$ of the top and bottom backup rolls 2A and 2B and the output from the roll eccentricity detection circuit 8 is applied to the roll eccentricity reproduction circuit 9. In response to the angles of rotation of the top and bottom backup rolls 2A and 2B, the reproduction circuit 9 reproduces the eccentricity $\Delta S_A^*$ and $\Delta S_B^*$ respectively, of the top and bottom backup rolls 2A and 2B and computes the combined roll eccentricity $\Delta S_E^*$ in accordance with Eq. (1). The result is then applied back to the roll eccentricity detection circuit 8 and is also applied as the roll gap manipulated variable $\Delta S_C$ to a hydraulic push-up control device 7. In response to the roll gap manipulated variable $\Delta S_C$, the hydraulic push-up control device 7 controls the position of the piston of a hydraulic push-up cylinder 6. Therefore the roll gap between the working rolls 1A and 1B is reduced by the amount which varies in response to the roll eccentricity so that the thickness of a rolled piece 10 is controlled with a high degree of accuracy.

Figure 2:
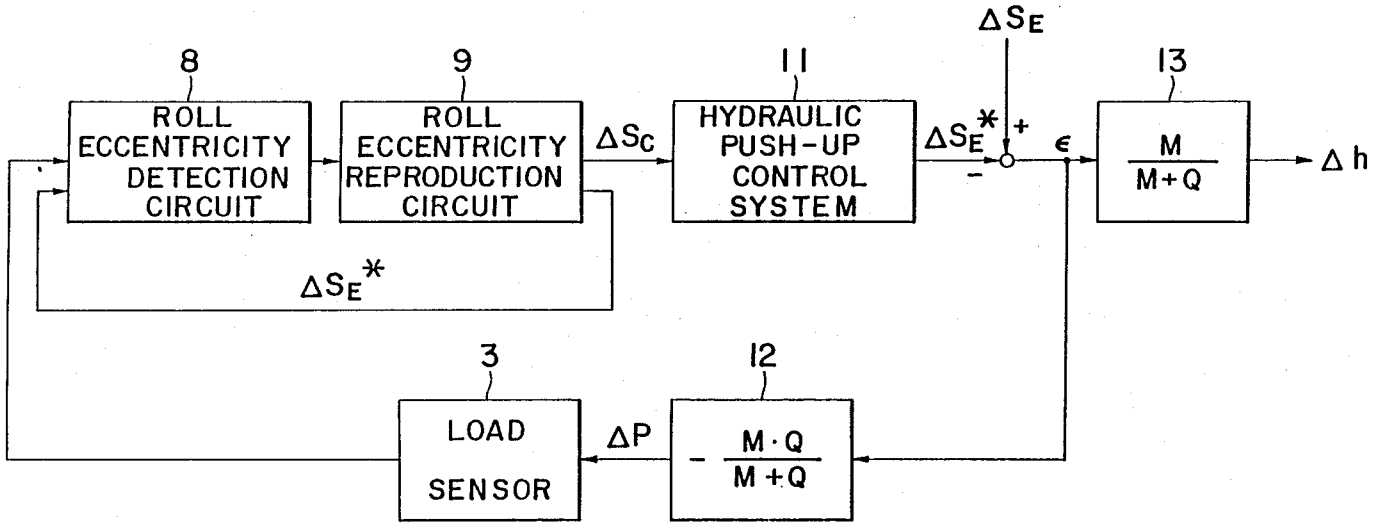
FIG. 2 is a block diagram of a roll-eccentricity-elimination control system shown in FIG. 1.

FIG. 2 is a block diagram of the system for controlling the elimination of the roll eccentricity shown in FIG. 1. In FIG. 2, a hydraulic push-up control system 11 is a block representing the transfer function up to a point at which the actual roll gap is obtained from the roll gap manipulated variable $\Delta S_C$ applied to the hydraulic push-up control device 7 shown in FIG. 1. Reference numeral 12 represents a block for representing the relationship between the roll gap variation and the rolling load variation; and 13, a block representing the relationship between the variations in the roll gap and the variations in thickness of the rolled products. In the blocks 12 and 13, M represents the mill constant while Q indicates the plasticity coefficient.

In response to the variation in roll gap due to the roll eccentricity $\Delta S_E$, the manipulated variable $\Delta S_C$ is derived from the roll eccentricity reproduction circuit 9 and when the roll gap is operated by $\Delta S_E^*$, the actual roll-gap variation $\epsilon$ is expressed by:

$$\epsilon = \Delta S_E - \Delta S_E^* \tag{4}$$

and the variations in thickness $\Delta h$ of the rolled products and the variations in rolling load are expressed by the following equations (5) and (6), respectively:

$$\Delta h = (M/(M+Q)\cdot\epsilon \tag{5}$$

and $$\Delta P = -(M\cdot Q/(M+Q))\cdot\epsilon \tag{6}$$

Therefore, when the roll eccentricity is detected with a high degree of accuracy and when it is so controlled that $\Delta S_E^* = \Delta S_E$, the variations in thickness of the rolled products and the variations in rolling load can be eliminated.

The algorithm for detecting the roll eccentricity will be described, referring next to FIGS. 3 and 4. In both of FIGS. 3 and 4, (a) represents the mark pulses of the top backup roll 2A derived from the mark pulse generator 4A; (b), the waveform of the eccentricity $\Delta S_A$ of the top backup roll 2A; (c), the mark pulses of the bottom backup roll 2B derived from the mark pulse generator 4B; (d), the waveform of the eccentricity $\Delta S_B$ of the bottom backup roll; and (e), the waveform of the combined roll eccentricity $\Delta S_E$. It should be noted here that the top and bottom backup rolls are different in rotational speed from each other.

Figure 3:
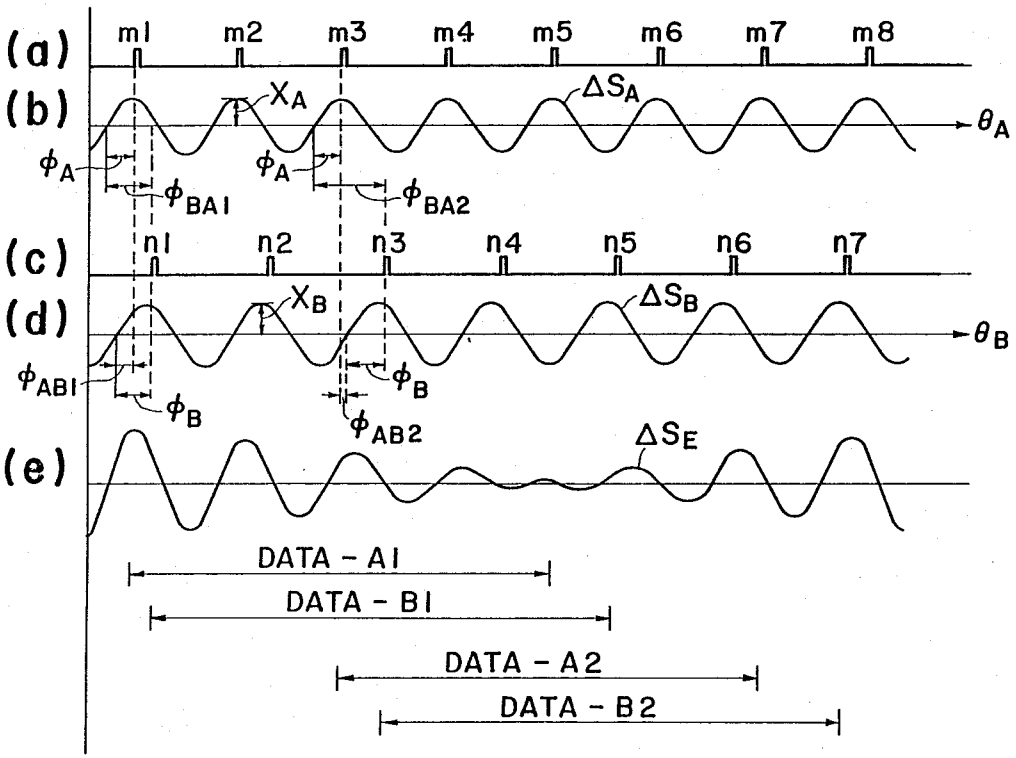
FIGS. 3 and 4 are views used to explain the detection of the roll eccentricity.

In FIG. 3, $\Phi_A$ represents the phase of the eccentricity $\Delta S_A$ of the top backup roll with respect to the mark pulses (a) thereof; and $\Phi_B$ indicates the eccentricity $\Delta S_B$ of the bottom backup roll with respect to the mark pulses (c) thereof. If the timing t for generating the mark pulses is 0 (t=0), then $\Phi_A$ and $\Phi_B$ in Eqs. (2) and (3) are equal to each other. Furthermore, $\Phi_{BA1}$ is the phase of the eccentricity $\Delta S_A$ of the top backup roll with respect to the first bottom-backup-roll mark pulse $n_1$; and $\Phi_{AB1}$ is the phase of the eccentricity $\Delta S_B$ of the bottom backup roll with respect to the first top-backup-roll mark pulse $m_1$. In like manner, $\Phi_{BA2}$ and $\Phi_{AB2}$ represent the phases, respectively, of the eccentricity of the top and bottom backup rolls, respectively, with respect to the third mark pulses $m_3$ and $n_3$, respectively. The combined roll eccentricity $\Phi S_E$ shown in FIG. 3(*e*) is in the form of a wave having surges because of the difference in rotational speed between the top and bottom backup rolls 2A and 2B. The combined roll eccentricity can be obtained from the detected rolling load.

Now let us consider the roll eccentricity $\Delta S_{11}$ in the DATA-A1 obtained between the top-backup-roll mark pulse $m_1$ (which is used as a reference pulse) and the fifth mark pulse $m_5$. Then the roll eccentricity $\Delta S_{11}$ is expressed by:

$$\Delta S_{11}=X_A\cdot\sin(\theta_A+\Phi_A)+X_B\cdot\sin(\theta_B+\Phi_{AB1}) \quad (7)$$

The roll eccenricity $\Delta S_{12}$ in the detected data DATA-B1 during four periods from the first bottom-backup-roll mark pulse $n_1$ and the fifth mark pulse $n_5$ is expressed by $$\Delta S_{12}=X_A\cdot\sin(\theta_A+\Phi_{BA1})+X_B\cdot\sin(\theta_B+\Phi_B) \quad (8)$$

In like same manner, the roll eccentricity $\Delta S_{21}$ in the detected data DATA-A2 obtained during the four periods between the third top-backup-roll mark pulse $m_3$ which is a reference pulse and the 7th mark pulse $m_7$ is expressed by:

$$\Delta S_{21}=X_A\cdot\sin(\theta_A+\Phi_A)+X_B\cdot\sin(\theta_B+\Phi_{AB2}) \quad (9)$$

and the roll eccentricity $\Delta S_{22}$ in the detected data DATA-B2 obtained during the four periods between the third or reference bottom-backup-roll mark pulse $n_3$ and the 7th mark pulse $n_7$ is expressed by:

$$\Delta S_{22}=X_A\cdot\sin(\theta_A+\Phi_{BA2})+X_B\cdot\sin(\theta_B+\Phi_B) \quad (10)$$

$$\text{where } \Phi_{AB2}=\Phi_{AB1}+\alpha \quad (11)$$

and $$\Phi_{BA2}=\Phi_{BA1}+\beta \quad (12)$$

Substituting Eq. (11) into Eq. (9) and Eq. (12) into Eq. (10), we have $\delta_1=(\Delta S_{11}-\Delta S_{21})$ and $\delta_2=(\Delta S_{12}-\Delta S_{22})$ from the following equations (13) and (14), respectively:

$$\begin{aligned}\delta_1 &= \Delta S_{11}-\Delta S_{21} \\ &= X_B\cdot\sin(\theta_B+\Phi_{AB1})-X_B\cdot\sin(\theta_B+\Phi_{AB1}+\alpha) \\ &= 2\cdot X_B\cdot\sin(-\alpha/2)\cdot\cos(\theta_B+\Phi_{AB1}+\alpha/2)\end{aligned} \quad (13)$$

and $$\begin{aligned}\delta_2 &= \Delta S_{12}-\Delta S_{22} \\ &= X_A\cdot\sin(\theta_A+\Phi_{BA1})-X_A\cdot\sin(\theta_A+\Phi_{BA1}+\beta) \\ &= 2\cdot X_A\cdot\sin(-\beta/2)\cdot\cos(\theta_A+\Phi_{BA1}+\beta/2)\end{aligned} \quad (14)$$

By the Fourier analysis of $\delta_1$ and $\delta_2$, we have $$\delta_1=X_1\cdot\sin(\omega t+\theta_1) \quad (15)$$

and $$\delta_2=X_2\cdot\sin(\omega t+\theta_2) \quad (16)$$

Hence, from Eqs. (13) and (15), $$X_B=X_1/(2\cdot\sin(-\alpha/2)) \quad (17)$$

and $$\Phi_B=\theta_1-\alpha/2+\pi/2 \quad (18)$$

and from Eqs. (14) and (16), we have $$X_A=X_2/(2\cdot\sin(-\beta/2)) \quad (19)$$

and $$\Phi_A=\theta_2-\beta/2+\pi/2 \quad (20)$$

where $\alpha$ and $\beta$ are the difference in phase between the mark pulses $m_1$ and $n_1$ and the difference in phase between the pulses $m_3$ and $n_3$. $\alpha$ represents the variations in phase of the bottom backup roll 2B with respect to the top backup roll 2A while $\beta$ shows the variations in phase of the top backup roll 2A with respect to the bottom backup roll 2B. The values of $\alpha$ and $\beta$ can be obtained by detecting not only the mark pulses but also the rotational speeds of the top and bottom backup rolls 2A and 2B and are known data.

So far the above explanation has been under the rolling conditions in which the control for making the roll eccentricity manipulated variable $\Delta S_C$ derived from the roll eccentricity reproduction circuit 9 shown in FIG. 2 zero is not made; that is, under the condition that the control for eliminating the roll eccentricity is not made.

Figure 4:
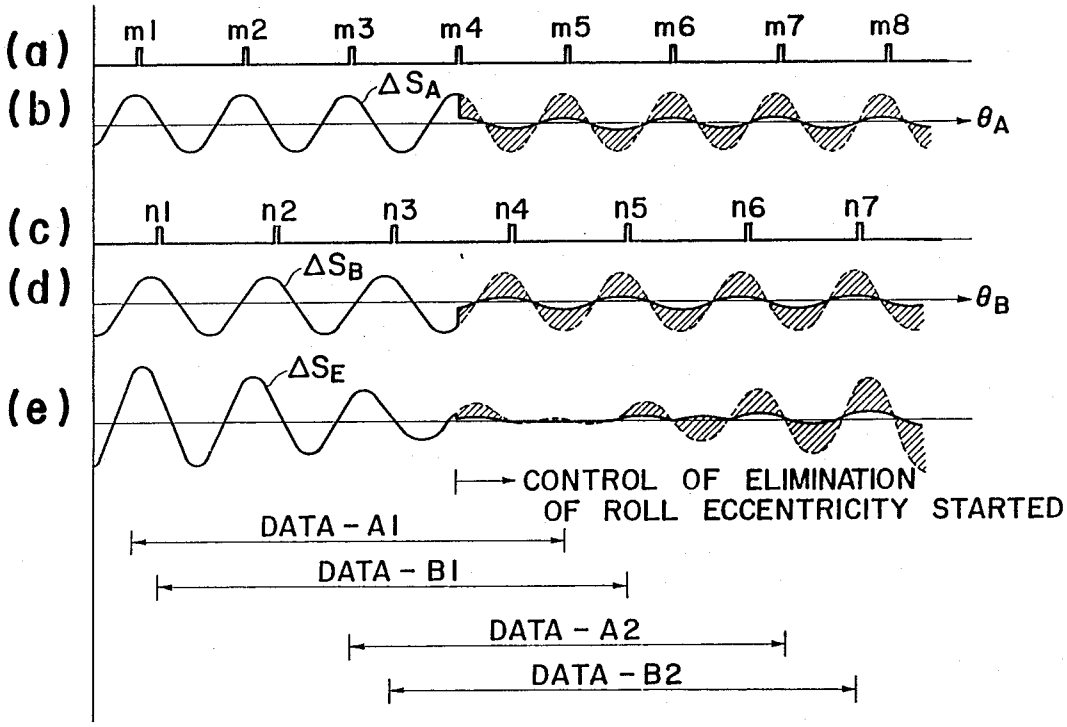

Referring next to FIG. 4, the algorithm used for the detection of $X_A$, $X_B$, $\Phi_A$ and $\Phi_B$ when the control for eliminating the roll eccentricity is carried out will be described. FIG. 4 shows that the roll eccentricity elimination control is started in response to the top-backup-roll mark pulse $m_4$ and thereafter the apparent amplitude of eccentricity is decreased as indicated by the solid line. That is, after the mark pulse $m_4$ has appeared, the magnitudes or quantities of the hatched portions shown in FIG. 4(*e*) represent the signal $\Delta S_E^*$ shown in FIG. 3 and the solid line represents the deviation signal $\epsilon$. When the control for eliminating the roll eccentricity is carried out in the manner described above, a true roll eccentricity to be detected is obtained in the form of the sum of the roll gap manipulated variable $\Delta S_E^*$ and the control deviation $\epsilon$ according to the equation (21) below:

$$\begin{aligned}\Delta S_E &= \Delta S_E^*+\epsilon \\ &= \Delta S_E^*-\Delta P\cdot(M+Q)/(M\cdot Q)\end{aligned} \quad (21)$$

That is, in FIG. 4, since the roll gap manipulated variable $\Delta S_E^*=0$ prior to the appearance of the top-backup-roll mark pulse $m_4$, a value detected from the variation $\Delta P$ in rolling load is used as $\Delta S_E$ and after the mark pulse $m_4$ has appeared, the sums of the roll gap manipulated variable $\Delta S_E^*$ and the control deviation $\epsilon$ detected from the variation $\Delta P$ in rolling load are used as the detected data DATA-A1, DATA-B1 DATA-A2 and DATA-B2. The method for obtaining the amplitudes and phases of eccentricity of the top and bottom backup rolls 2A and 2B, respectively, from the detected data thus obtained is substantially similar to that described above with reference to FIG. 3.

As described above, the detection, reproduction and control are carried out successively so that the amplitudes $X_A$ and $X_B$ and the phases $\Phi_A$ and $\Phi_B$ of eccentricity are adjusted, whereby the detection of the roll eccentricity and the elimination control can be carried out at a high degree of accuracy. As a result, the thickness of the rolled product can be controlled with a high degree of accuracy and the stable rolling operation can be ensured.

Figure 5:
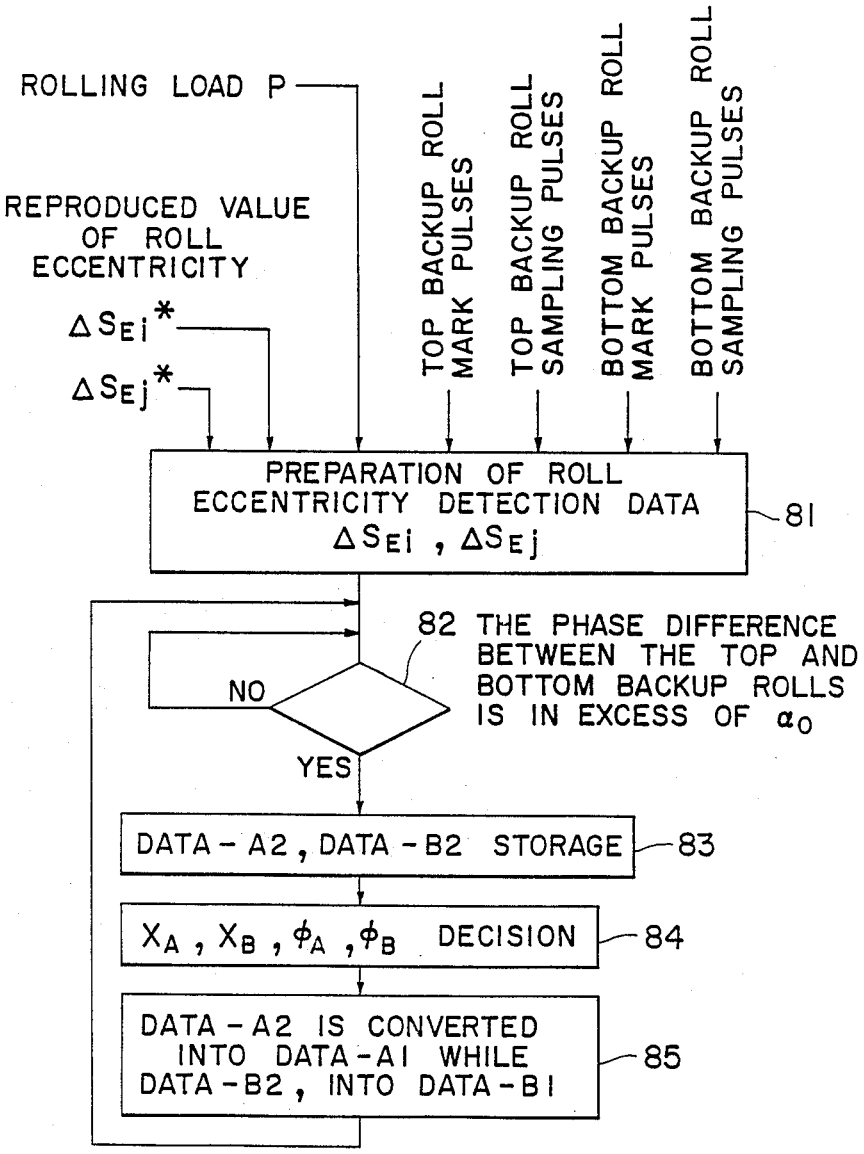
FIG. 5 is a flowchart of the roll eccentricity detection in accordance with the present invention.
Figure 6:
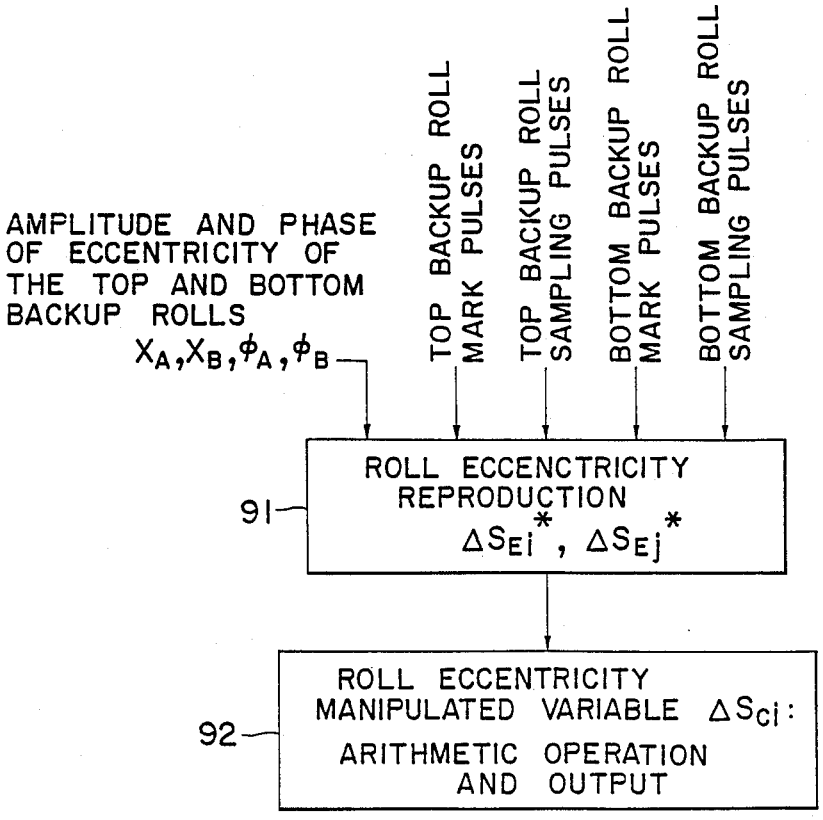
FIG. 6 is a flowchart used to explain the roll eccentricity reproduction in accordance with the present invention.

Referring next to FIGS. 5 and 6, the roll eccentricity detection circuit 8 and the roll eccentricity reproduction circuit 9 will be described in detail below.

At first the preparation of the roll eccentricity detection data is carried out at step 81 in FIG. 5, in which BUR is used to represent a backup roll. The inputs signals at the step 81 are mark pulses and sampling pulses of the top and bottom backup rolls, the rolling load P and the roll eccentricity reproduction signal $\Delta S_E^*$ from the roll eccentricity reproduction circuit 9. The roll eccentricity $\Delta S_{Ei}$ at a time when the top backup roll sampling pulse is generated and the roll eccentricity $\Delta S_{Ej}$ at a time when the bottom backup roll sampling pulse is generated are computed by the following equations (22) and (23), respectively, which represent Eq. (21) in terms of a sampled value system and then stored.

$$\Delta S_{Ei}=\Delta S_{Ei}^*-\Delta P_i\cdot(M+Q)/(M.Q) \quad (22)$$

and $$\Delta S_{Ej}=\Delta S_{Ej}^*-\Delta P_j\cdot(M+Q)/(M.Q) \quad (23)$$

where $$\Delta P_i=P_i-P^L \quad (24)$$

and $$\Delta P_j=P_j-P^L \quad (25)$$

where i represents a number of the top backup roll sampling pulses generated from its first pulse; j represents a number of the bottom backup roll sampling pulses counted from their first pulse; and $P^L$ indicates a lock-on value of the rolling load.

The step 82 in FIG. 5 checks whether or not the phase between the top and bottom backup roll mark pulses is deviated in excess of the phase angle $\alpha_0$ from the phase at the time when the measurement of the detected data DATA-A1 is started. FIG. 5 shows a general case in which the data DATA-A1 and DATA-B1 have been already measured. Then the phase is not in excess of the angle $\alpha_0$ such check is repeated everytime when one top backup roll mark pulse is generated. On the other hand, when the phase is detected in excess of the angle $\alpha_0$, the program proceeds to the step 83 in which the roll eccentricity $\Delta S_{Ei}$ obtained during four rotations of the top backup roll just immediately after the step 83 is detected and stored as the detected data DATA-A2 and simultaneously the roll eccentricity $\Delta S_{Ej}$ obtained during four rotations of the bottom backup roll from a time when the bottom backup roll mark pulse is generated is detected and then stored as DATA-B2.

In the next step 84, the arithmetic operations are accomplished according to Eqs. (13) and (14), respectively, whereby $\delta_{1i}$ and $\delta_{2j}$ are obtained. Thereafter, the values thus obtained are subjected to the Fourier analysis and $X_A$, $X_B$, $\Phi_A$ and $\Phi_B$ are obtained according to Eqs. (17)–(20) and are delivered to the roll eccentricity reproduction circuit 9.

At the step 85, in order to prepare for the next detection, the data used as DATA-A2 is transferred to DATA-A1 while the data used as DATA-B2 is transferred to DATA-B1. Thereafter the program returns to the step 82 and the same program is executed repeatedly.

FIG. 6 is a flowchart illustrating the process carried out by the roll eccentricity reproduction circuit 9. The inputs to the reproduction circuit 9 are mark pulses and sampling pulses obtained from the top and bottom backup rolls and the amplitudes $X_A$ and $X_B$ and phases $\Phi_A$ and $\Phi_B$ of roll eccentricity derived from the roll eccentricity detection circuit 8. First at the step 91, the amplitudes of roll eccentricity are reproduced according to Eqs. (26)–(31) when the sampling pulses are generated by the top and bottom backup rolls.

$$\Delta S_{Ai}^*=X_A\cdot\sin(\theta_{Ai}+\Phi_A) \quad (26)$$

$$\Delta S_{Bi}^*=X_B\cdot\sin(\theta_{Bi}+\Phi_B) \quad (27)$$

$$\Delta S_{Ei}^*=\Delta S_{Ai}^*+\Delta S_{Bi}^* \quad (28)$$

$$\Delta S_{Aj}^*=X_A\cdot\sin(\theta_{Aj}+\Phi_A) \quad (29)$$

$$\Delta S_{Bj}^*=X_B\cdot\sin(\theta_{Bj}+\Phi_B) \quad (30)$$

and $$\Delta S_{Ej}^*=\Delta S_{Aj}^*+\Delta S_{Bj}^* \quad (31)$$

The eccentricity $\Delta S_{Ei}^*$ and $\Delta S_{Ej}^*$ obtained from Eqs. (28) and (31), respectively, are applied to the roll eccentricity detection circuit 8 so as to obtain the roll eccentricity $\Delta S_{Ei}$ and $\Delta S_{Ej}$ in accordance with Eqs. (22) and (23), respectively. Either of $\Delta S_{Ei}^*$ or $\Delta S_{Ej}^*$ (for instance, $\Delta S_{Ei}^*$ in FIG. 6) is delivered to the next step 92.

At the step 92, as shown in Eq. (32), the roll gap manipulated variable $\Delta S_{Ci}$ is obtained by multiplying $\Delta S_{Ei}^*$ by the phase compensation or correction coefficient G(Z) and is applied to the hydraulic push-up control device 7.

$$\Delta S_{Ci}=G(Z)\cdot\Delta S_{Ei}^* \quad (32)$$

G(Z) is the coefficient for compensating for delay in response time in the hydraulic push-up control system 11 so that the phase of the actual roll eccentricity is made in coincidence with the phase of the roll gap manipulated variable, but it does not constitute the present invention so that no further description shall be made in this specification.

So far the present invention has been described in detail in conjunction with the fundamental frequency, but it is to be understood that the present invention may be also equally applied to harmonics so that the detection, reproduction and control can be accomplished.

What is claimed is:

1. A method of controlling elimination of roll eccentricity in a rolling mill of the type in which a pair of upper and lower working rolls are backed up by backup rolls, comprising the steps of:

obtaining combined roll gap variations $\Delta S_{11}$ and $\Delta S_{21}$ which are sums of roll gap variations computed from variations in rolling load obtained in response to angle of rotation of a top backup roll when differences in the angle of rotation between the top backup roll and a bottom backup roll detected at different time points are $\Phi_{AB1}$ and $\Phi_{AB2}$ on the one hand and a roll gap manipulated variable for eliminating the roll eccentricity of said rolling mill on the other hand and storing said combined roll gap variations $\Delta S_{11}$ and $\Delta S_{21}$ thus obtained;

obtaining amplitude $X_B$ of the roll eccentricity and phase $\Phi_B$ of said bottom backup roll by Fourier analysis of a difference between said combined roll gap variations $\Delta S_{11}$ and $\Delta S_{21}$;

obtaining combined roll gap variations $\Delta S_{12}$ and $\Delta S_{22}$ which are sums of roll gap variations obtained from variations in said rolling load obtained in response to the angle of rotation of the bottom backup roll when the differences in the angle of rotation of the top backup roll with respect to said bottom backup roll detected at different time points are $\Phi_{BA1}$ and $\Phi_{BA2}$ on the one hand and the roll gap manipulated variable for eliminating the roll eccentricity of said rolling mill on the other hand and storing said combined roll gap variations $\Delta S_{12}$ and $\Delta S_{22}$ thus obtained;

computing amplitude $X_A$ and phase $\Phi_A$ of the eccentricity of said top backup roll by Fourier analysis of a difference between said combined roll gap variations $\Delta S_{12}$ and $\Delta S_{22}$;

computing combined roll eccentricity by using the amplitudes $X_A$ and $X_B$ and phases $\Phi_A$ and $\Phi_B$ of eccentricity of said top and bottom backup rolls; and adjusting the roll gap in said rolling mill so as to eliminate said combined roll eccentricity.

2. A method according to claim 1, wherein said controlling is applied to an associated fundamental frequency of the roll eccentricity.

3. A method according to claim 1, wherein said controlling is applied to an associated fundamental frequency and higher harmonics of the roll eccentricity.

4. A device for controlling elimination of roll eccentricity in a rolling mill of the type in which a pair of working rolls are backed up by backup rolls, comprising:

a first detection means for detecting angle of rotation of a top backup roll;

a second detection means for detecting the angle of rotation of a bottom backup roll;

a load sensor for detecting rolling load;

an arithmetic operation means for:

(i) computing and storing combined roll gap variations $\Delta S_{11}$ and $\Delta S_{21}$ which are sums of the roll gap variations obtained from the rolling loads detected by said load sensor in response to the angle of rotation of said top backup roll when differences between the angle of rotation of said top backup roll detected by said first detection means and the angle of rotation of said bottom backup roll detected by said second detection means at different detection time points are $\Phi_{AB1}$ and $\Phi_{AB2}$ on the one hand and a roll gap manipulated variable for eliminating the roll eccentricity of said rolling mill on the other hand, (ii) computing amplitude $X_B$ and $\Phi_B$ of the bottom backup roll by Fourier analysis of a difference between said combined roll gap variations $\Delta S_{11}$ and $\Delta S_{21}$, (iii) computing and storing combined roll gap variations $\Delta S_{12}$ and $\Delta S_{22}$ which are sums of roll gap variations computed from the variations in rolling load detected by said load sensor in response to the angle of rotation of the bottom backup roll when the differences of the angle of rotation detected by said first detection means of said top backup roll from the angle of rotation detected by said second detection means of said bottom backup roll at different detection time points are $\Phi_{BA1}$ and $\Phi_{BA2}$ on the one hand and the roll gap manipulated variable for eliminating the roll eccentricity of said rolling mill on the other hand, (iv) computing amplitude $X_A$ and phase $\Phi_A$ of the eccentricity of said top backup roll by Fourier analysis of a difference between the combined gap variations $\Delta S_{12}$ and $\Delta S_{22}$ stored, and (v) computing combined roll eccentricity by using the amplitudes $X_A$ and $X_B$ and phases $\Phi_A$ and $\Phi_B$ of eccentricity of said top and bottom backup rolls computed; and an adjusting means for adjusting the roll gap of said rolling mill so as to eliminate the combined roll eccentricity obtained by said arithmetic operation means.

5. A device for controlling the elimination of the roll eccentricity in a rolling mill of the type in which a pair of rotatable working rolls are backed up by a pair of rotatable backup rolls, comprising:

a roll eccentricity detection circuit;

a roll eccentricity reproduction circuit;

a hydraulic push-up control device including a positioning piston;

mark pulse generator means coupled to each backup roll for generating mark pulse signals to said detection and reproduction circuits when each backup roll rotates;

sampling pulse generator means coupled to each backup roll for generating a predetermined number n of sampling pulses to said detection and reproduction circuits when each backup roll rotates; and load sensor means for detecting rolling load and outputting a signal to said roll eccentricity detection circuit, whereby the roll eccentricity detection circuit detects amplitudes of eccentricity and phase of the top and bottom backup rolls, and produces an output applied to the roll eccentricity reproduction circuit which, in response to angles of rotation of the top and bottom backup rolls, reproduces the eccentricity of the top and bottom backup rolls and computes combined roll eccentricity for providing a signal applied back to the roll eccentricity detection circuit and to the hydraulic push-up control device for positioning the piston thereof, wherein the eccentricity of the top and bottom backup rolls respectively are derived in accordance with the mark pulse signals associated with the bottom and top backup rolls, respectively.

* * * * *